United States Patent [19]

Kubicki, Sr.

[11] 3,940,081

[45] Feb. 24, 1976

[54] FLAT CORE FOR WEB WINDINGS

[76] Inventor: Eugene Joseph Kubicki, Sr., 10325 Hollingsworth Road, Kansas City, Kans. 66109

[22] Filed: Feb. 25, 1974

[21] Appl. No.: 445,074

[52] U.S. Cl. ..... 242/68.5

[51] Int. Cl.[2] ..... B65H 75/02

[58] Field of Search ..... 242/68.5, 68.6, 68, 68.3, 242/71.8, 74, 78.3, 118.8, 77.3

[56] References Cited

UNITED STATES PATENTS

| | | | |
|---|---|---|---|
| 1,262,135 | 4/1918 | Sundh | 242/78.3 |
| 1,687,938 | 10/1928 | Johnstone | 242/68.5 X |
| 2,212,309 | 8/1940 | Swanson | 242/68.5 |
| 2,695,139 | 11/1954 | Horvath | 242/68.5 |
| 3,062,370 | 11/1952 | Morin | 242/60 X |
| 3,203,453 | 8/1965 | McConnell | 242/68.5 X |
| 3,439,881 | 4/1969 | Ulmschneider | 242/74 |
| R5,725 | 1/1874 | Sutro | 242/85.1 |

*Primary Examiner*—Stanley N. Gilreath
*Assistant Examiner*—John M. Jillions
*Attorney, Agent, or Firm*—Schmidt, Johnson, Hovey & Williams

[57] ABSTRACT

A low-cost flexible, initially flat, relatively thin, nonmetallic core for supporting a web of material wound therearound and which is adapted to be positioned about a cylindrical winding mandrel in a smooth, closely fitting, circumscribing fashion without an attentant core slippage problem as has occurred with past devices for this purpose. A tongue forming a part of the core blank is provided for insertion within an axial slot in the winding mandrel, thereby positively preventing relative movement between the core member and the mandrel. In a preferred form, the core is fabricated from paper stock or yieldable synthetic resinous materials with the tongue thereon which is bendable for insertion in the mandrel slot being either removable or shiftable to recessed position after use thereof for maintaining a smooth, continuous, uninterrupted inner surface on the web core. By virtue of the thin, flat, nonmetallic nature of the core, fabrication, shipping and storage costs are drastically reduced and installation thereof is quickly and easily accomplished without resort to complicated apparatus for insuring a secure, nonslip fit on the winding mandrel. Means are also provided for facilitating proper positioning of the cores on the winding mandrel.

7 Claims, 14 Drawing Figures

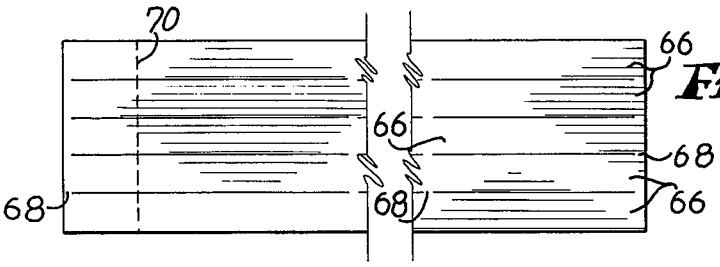
Fig. 8.
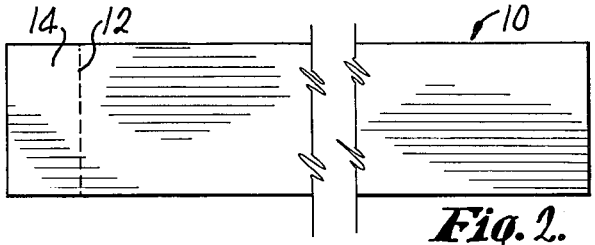
Fig. 2.
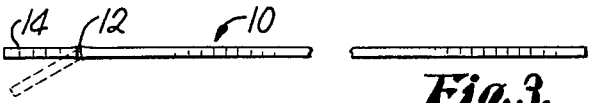
Fig. 3.
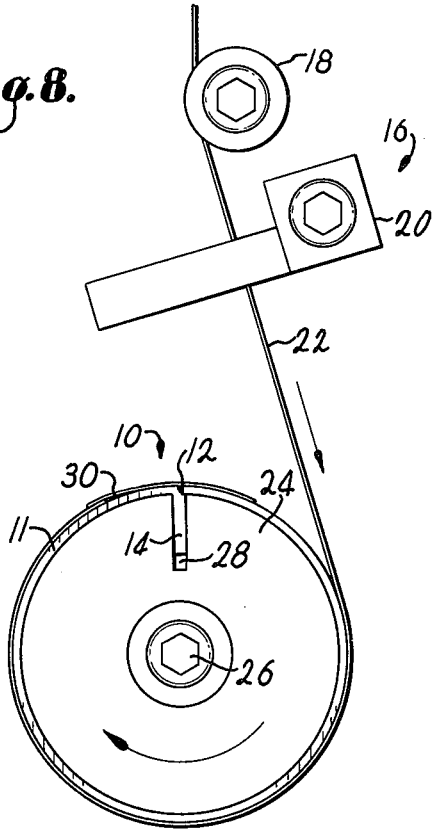
Fig. 1.
Fig. 5.
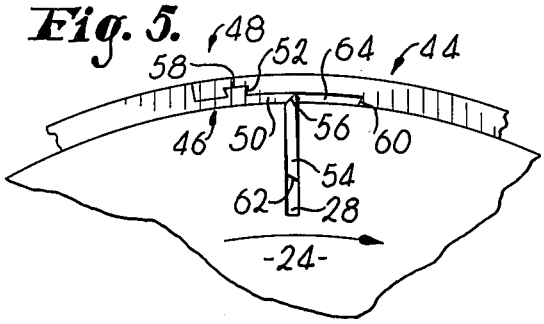
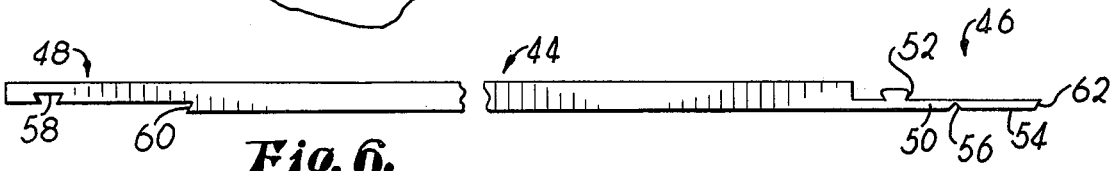
Fig. 6.
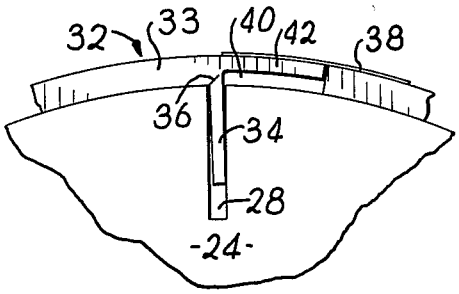
Fig. 7.
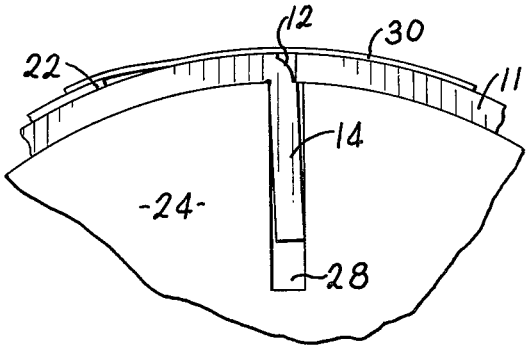
Fig. 4.

Fig. 9.
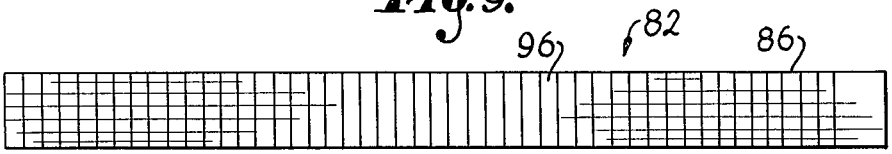
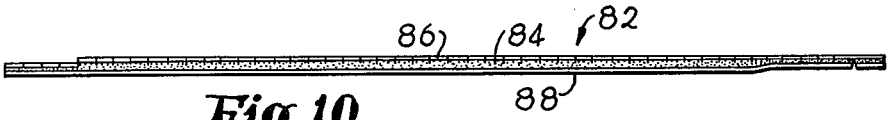
Fig. 10.
Fig. 11.
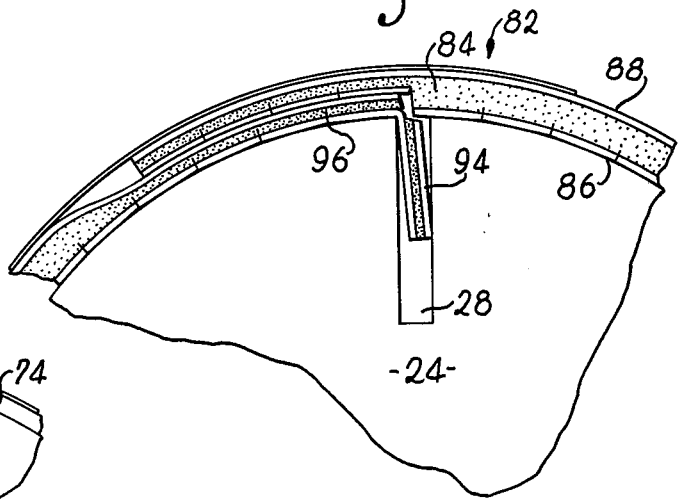
Fig. 12.
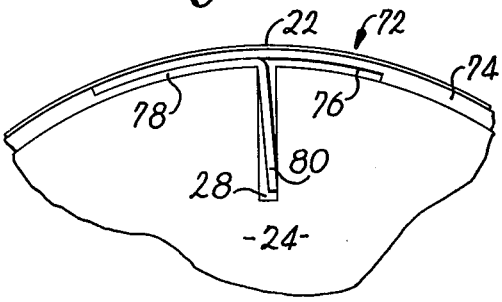
Fig. 13.
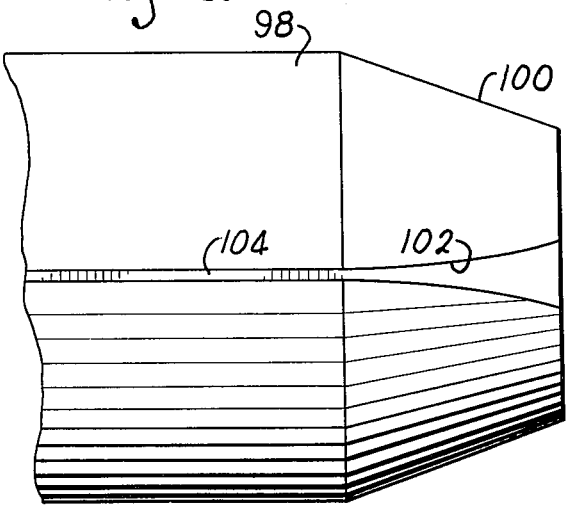
Fig. 14.
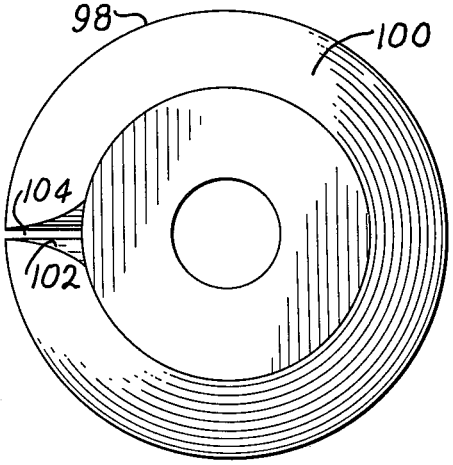

FLAT CORE FOR WEB WINDINGS

BACKGROUND

This invention relates to nonslip, low-cost, initially flat web cores which substantially reduce fabrication, shipping and storage costs and are adapted for use with winding mandrels wherein elongated webs of ribbon or tape materials are wound thereabout to produce finished rolls. More particularly, it is concerned with web cores which include bendable tongues thereon adapted for insertion within an axial slot on the winding mandrel for precluding rotational slippage of the core relative to the mandrel.

In the production of finished rolls of ribbons, adhesive tapes or label stocks and the like, it is a common practice to employ apparatus for simultaneously producing a number of small finished rolls from a large master supply thereof. For example, in the production of rolls of adhesive tape for individual use, a master roll is utilized and individual roll portions are produced by successively slitting the width thereof into a plurality of relatively narrow webs followed by winding on the latter onto individual web cores. In these procedures, individual web cores are conventionally attached to high-speed rotatable winding mandrels and the elongated webs are attached thereto to produce the finished rolls.

The most common web cores heretofore available have consisted simply of cylindrical segments of thin cardboard or plastic which are adapted to be slipped onto an appropriate mandrel for winding of tape or other material therearound. However, in practice it has been discovered that the use of these cylindrical members present a number of serious and heretofore unsolved problems.

One objectionable feature of almost all prior web cores stems from the fact that it is exceedingly difficult to insure a non-slip fit between the core and the winding mandrel. In many instances, workers in the art have resorted to the use of air expandable or hydraulic mandrels, or mandrels having mechanical expansion means such as radially shiftable core engaging teeth in an attempt to obviate this problem. Such devices can be radially expanded as desired after the core is installed thereon in order to hold the latter in its proper position. As can be appreciated however, such complicated apparatus is extremely costly to purchase and use and is time consuming to manipulate. The worker must first position the cylindrical web core on the mandrel in proper alignment therewith and subsequently insure a non-slip fit therebetween by operation of the expanding mechanism associated with the mandrel. This in many cases requires considerable skill, since if the core is too loose on the one hand relative rotative slippage thereof will occur while on the other hand if the mandrel itself is expanded beyond the limits of the circumscribing core, the latter can be torn or otherwise damaged.

An equally important problem associated with the prior cores results from the fact that they were extremely costly to ship and store. By virtue of their cylindrical configuration, they required considerable space while nevertheless being relatively light in weight. Accordingly, due to the large bulk of these cores, the shipping and storage charges associated therewith oftentimes exceeded the actual production costs thereof. Moreover, these problems were compounded because of the necessity of stocking a large inventory of cores of different sizes and widths, which of course materially increased the cost to those utilizing web cores of this type.

In an attempt to overcome the foregoing problems, it has been suggested to employ initially flat web core blanks which can be wrapped about a mandrel and attached thereto to provide the requisite core. In general however, these prior flat core blanks have found little acceptance in the art because of their inability to overcome the problems associated with core slippage. Additionally, the resultant cores were objectionable because there was no way to interconnect the distal ends thereof on the mandrel while nevertheless maintaining a substantially smooth, uninterrupted and continuous arcuate winding surface. That is, use of many of these core blanks required that the ends thereof be overlapped and interconnected by means of complemental tongue and slot structure or the like which of necessity created a bulge or projection along the arcuate surface of the resultant core. As can be appreciated, when an elongated web of material was wound thereabout, the finished roll likewise exhibited an irregular projection thereon by virtue of the underlying irregularity on the web core itself.

Finally, because of the lack of resilience in prior web cores, if they become bent or misshapen (either during shipping or after a web is wound thereabout) there was no practical way to reuse the core. This is particularly significant in cases where intermediate rewindings occur between the master roll and final product. In cases where an intermediate roll core becomes distorted, it is often necessary to discard the entire roll of material since there is no acceptable method of effecting a further rewind thereof. As can be appreciated, this can be an extremely costly problem to the commercial fabricator of finished roll materials. These problems are further compounded by virtue of the fact that the mandrels commonly in use have no mechanical adaptor or the like which permits use of partially misshapen web cores. Thus, if a core does not remain essentially perfect during shipping, storage and initial rewindings, it can become useless and even be the cause of significant commercial losses.

Therefore, there is a need in the art for a lowcost, flexible resilient web core blank that is easily and quickly installable on a winding mandrel without resort to complicated apparatus, is initially flat for ease of storage and shipping, and which effectively avoids problems associated with core slippage while maintaining a smooth, continuous uninterrupted winding surface when installed upon a rotatable mandrel.

SUMMARY

Accordingly, it has been discovered that web cores of the class described can be provided which broadly comprise flat, relatively thin, flexible nonmetallic web core blanks which are adapted to be positioned about cylindrical mandrels in a closely fitting, circumscribing fashion to give an improved web core. A bendable tongue is attached to at least one end of each web core blank and is operable to be inserted within an axial slot provided for this purpose in the winding mandrel. The distal ends of the core blank are adapted to be interconnected by taping or through the use of complemental connection structure thereon which does not appreciably deform the desirable method, continuous arcuate outer surface of the core.

During installation procedures, the tongue is inserted within the described mandrel slot and the flexible core blank is wrapped about the cylindrical mandrel to produce a web core with substantially smooth and uninterrupted inside and outside arcuate surfaces. Installation thereof is completed by interconnecting the distal ends of the core blank as by applying a stretch of adhesive tape thereacross in the case of cores fabricated from paper stock.

The tongue portion of the core acts to positively preclude relative rotational slippage of the core during winding operations by the mechanical securement obtained between the tongue and slot. Moreover, it is noteworthy that this function obtains during both clockwise and counterclockwise highspeed rotations of the mandrel without the need for modification of the web core. Furthermore, it is a simple matter to remove the finished roll of material from the mandrel simply by sliding the roll and core in an axial direction until the tongue of the latter exits from the mandrel slot.

In one preferred form of the invention the web core blank is a laminated paper construction having the respective end margins thereof of reduced thickness on opposite sides of the core. This permits the core to be wrapped about a winding mandrel with the outermost terminus of one reduced end inserted within the mandrel slot, while the remaining end overlies the tab end to form a junction therewith. In this fashion, the respective ends of the blanks can be joined without producing the undesirable surface projection alluded to above. In another mode of the invention, a web core is fabricated from paper stock and includes a transverse perforation line proximal to one distal end thereof. By provision of this construction, the tongue portion defined by the perforation line can be removed by tearing when the finished roll is taken from the winding mandrel. This produces a desirable smooth uninterrupted inner surface on the web core and facilitates the ultimate employment of the finished rolls on standard reels provided for such use.

In another embodiment, the core blank is composed of synthetic resinous material such as polypropylene and is constructed similar to the first mentioned embodiment in that the opposed ends thereof are designed to overlap during installation on the mandrel. In this form, the overlapping ends of the core blank are of lesser thickness than that of the main body thereof such that when overlapped, the combined thicknesses of the ends are substantially equal to that of the remainder of the core. Moreover, interconnection of the overlapped ends is facilitated by provision of complementary tab and recess structure on the respective ends which produces a frictional, snap-fit interconnection therebetween.

Means are also provided for facilitating installation of the core blanks on an axially slotted mandrel, or for repositioning an intermediate winding roll on the mandrel prior to final rewinding onto additional web cores to produce a finished product. The device in general comprises a smoothly tapered, slotted "bullet nose" which is axially aligned with the mandrel and forms the leading portion thereof. By provision of a tapered slot in the nose in communication with the axial mandrel slot, the core tongue can be inserted therewithin and the core slid axially upwardly and thence onto the mandrel itself. As can be appreciated, if a core is misshapen the latter can be progressively reformed during such installation so that the core has the requisite conformity with the mandrel to facilitate proper installation thereon.

By virtue of the thin, flat nature of the web core blanks of this invention, shipping and storage costs associated therewith are significantly reduced. For example, while a week's supply of the prior cylindrical cores could conceivably fill an entire room, the same number of core blanks in accordance with the present invention could quite easily be stored in a single box adjacent the appropriate winding mandrel.

DRAWINGS

FIG. 1 is a side elevational view of a winding station shown during operation thereof and having an axially slotted, cylindrical winding mandrel with a web core in accordance with the present invention operatively positioned thereon;

FIG. 2 is a top plan view of a web core blank in accordance with this invention; illustrating the transverse perforation line which defines the bendable tongue thereof;

FIG. 3 is a side elevational view of the web core blank shown in FIG. 2 with the bendable nature of the tongue illustrated by the phantom lines;

FIG. 4 is a fragmentary, greatly enlarged, side elevational view illustrating the connection between the web core and mandrel as depicted in FIG. 1;

FIG. 5 is a fragmentary, enlarged, side elevational view showing a synthetic resin web core having interconnected, overlapping ends and installed upon a slotted winding mandrel;

FIG. 6 is a side elevational view of the synthetic resin web core blank as depicted in use in FIG. 5 in its initially flat configuration prior to the installation thereof on a slotted mandrel;

FIG. 7 is a fragmentary, enlarged side elevational view showing another type of web core in accordance with the invention in use upon a slotted winding mandrel;

FIG. 8 is a top plan view of a plurality of elongated, relatively narrow web core blanks in their initially flat configuration which are interconnected at spaced intervals along the length thereof.

FIG. 9 is a top plan view of a laminated synthetic foam web core blank showing transverse slits therein for facilitating bending of the blanks about a mandrel to produce the requisite smooth, outer arcuate surface on the core;

FIG. 10 is a side elevational view of the web core blank shown in FIG. 9;

FIG. 11 is an enlarged, fragmentary view showing the core blank of FIGS. 9 and 10 positioned on a winding mandrel;

FIG. 12 is an enlarged fragmentary view as in FIG. 11 showing a web core blank composed of paper stock and having the respective end margins thereof of reduced thickness on opposite sides of the blank, so that the latter can be positioned about a mandrel as depicted with the end margins thereof overlapped without producing an undesirable surface irregularity in the core;

FIG. 13 is a fragmentary, plan view of an axially slotted winding mandrel having an axially aligned, tapered, slotted leading projection thereon to facilitate positioning of a core on the mandrel; and FIG. 14 is a front elevational view of the mandrel assembly shown in FIG. 13.

DETAILED DESCRIPTION

Referring now to the drawings, there is shown in FIG. 2 an initially flat, relatively thin, flexible web core blank 10 composed of cardboard or other paper stock. Core blank 10 is a rectangular sheet having a transverse perforation line 12 spaced inwardly from and parallel to one extreme transverse edge thereof. Perforation line 12 defines a bendable tongue 14 which is connected to and forms one extreme end of core blank 10. As shown in phantom in FIG. 3, tongue 14 is bendable along perforation line 12 for purposes to be made clear hereinafter.

Turning now to FIG. 1, a web winding station 16 is shown which includes separate conventional web alignment means 18 and 20 that serve to correctly track the elongated web of material 22 which is to be wound about an underlying web core to produce finished rolls thereof. The winding station also includes a rotatable, cylindrically shaped winding mandrel 24 which is essentially a cylindrical body journaled about an axial shaft (not shown) and secured thereon by means of nut 26. The connection between mandrel 24 and the axial shaft can in some instances be secured by means of a recessed setscrew (not shown) extending through mandrel 24 which is adapted to be threadably set against the axial shaft as needed.

The core 11 presented by blank 10 is of lesser width than mandrel 24 and as shown in FIG. 1, is positioned about the latter in a closely fitting, circumscribing manner for producing substantially smooth and uninterrupted inside and outside arcuate surfaces thereon. Additionally, tongue 14 defining one extreme end of core blank 10 is inserted into axial slot 28 which is provided for this purpose in mandrel 24. Slot 28 preferrably extends in an axial direction along mandrel 24 through the forward end face thereof and is radially aligned with respect thereto to facilitate use and removal of the web cores of the present invention.

The distal ends of the core blank 10 are adapted in this instance to meet in aligned, abutting relationship as most easily seen in FIG. 4. These separate ends are interconnected by means of a short stretch of adhesive masking tape 30 which extends across the joint defined by transverse perforation line 12 and the distal end of core blank 10. Moreover, the initial segment of web 22 to be wound upon core 11 can be attached thereto by means of tape 30. As shown in FIG. 4, tape 30 extends across the joint as described and is also in covering, holding relationship to the terminal end of web 22. In this fashion, the initial winding of web 22 can be started without difficulty and without producing a noticeable bulge or projection in the substantially smooth and uninterrupted arcuate surfaces of web core 10.

During installation procedures with this type of web core blank, the worker first bends tongue 14 inwardly along transverse perforation line 12 and inserts the same into slot 28 of mandrel 24. The remainder of core blank 10 is then wrapped about mandrel 24 to produce the requisite smooth, arcuate core surfaces. The distal ends of the core blank are next aligned and interconnected by means of tape 30, and the terminal end of web 22 can then be attached thereto as described. It should also be noted that during winding operations with adhesive tape, there is generally no need for the separate hold-down stretch 30. Instead, the terminal end of the tape web itself is applied across the joint between the ends of the core blank to produce the requisite interconnection therebetween and the initial connection between the web and core.

After a few turns of mandrel 24 to insure that web 22 is accurately aligned thereon high-speed winding operations can be commenced. When a sufficient length of web 22 has been wound about core 11, winding operations are interrupted, the web is cut, and the entire finished roll is slid axially along slot 28 and off the mandrel 24. The worker can at this point remove the tongue 14 simply by tearing the latter along perforation line 12 to produce a smooth inner web core surface. Optionally, the tongue 14 can be left in place for ultimate use with reels having a slot similar to slot 28 in mandrel 24.

It will be appreciated from the foregoing that during winding operations, relative rotational slippage between core 11 and mandrel 24 is positively precluded. Specifically, when mandrel 24 is rotated even at high speeds, core 11 is prevented from slipping by virtue of the abutment of the planar surfaces of tongue 14 against the walls of slot 28, and the close fit of the core 11 about the mandrel maintained by tape 30. Moreover, it is significant that positive core attachment to the mandrel obtains during both clockwise and counterclockwise mandrel rotations, so that the cores disclosed herein are not limited to any particular type of winding operations.

The most preferred embodiment of the invention is depicted in FIG. 12 and includes a paper core blank 72 which is positioned about mandrel 24 to form core 74. Blank 72 can be formed from a single sheet of paper or can be laminated; but in either case the respective end margins thereof are reduced as at 76 and 78 on opposite faces of the blanks to permit an overlapping of the ends thereof without undesirable surface irregularities in core 74. As shown in FIG. 12, the forward end of the underlying marginal portion is bent downwardly to define tongue 80 which is important for the purposes explained. Similarly, the end margins of the blank are joined by means of a hold-down stretch or simply by the end of web 22 as depicted.

Turning now to FIG. 7, yet another web core blank composed of paper is shown and referred to by the numeral 32. In this instance, a relatively thick cardboard member is slit longitudinally at one transverse end thereof in order to define a bendable flap 34 which is cut from the thickness of core blank 32 and is adapted to be inserted within slot 28 of mandrel 24. Flap 34 is further defined by a transverse line of weakness 36 which facilitates bending of the flap and insertion thereof within slot 28. Referring to the drawing, it can be seen that the distal ends of the core blank 32 are in aligned, abutting relationship and are interconnected by means of a stretch of masking tape 38 to produce the resultant cylindrical web core 33. Underlying the left-hand end of core 33 is bendable flap 34 which extends into slot 28 for the purposes outlined. Moreover, because flap 34 is cut from the thickness of core blank 32, a recess 40 results which is defined by the overlying left-hand end 42 of core 33 and the underlying mandrel 24.

Installation of core blank 32 is identical to that described above in connection with blank 10 and therefore will not be described in detail. However, upon removal of a finished roll of material employing the resultant web core 33, flap 34 is generally not removed but is simply tucked into recess 40 in order to produce the desirable smooth inner arcuate surface thereon.

However, flap 34 can again be turned downwardly and employed on reels which are provided with a slot similar to that on mandrel 24, should the need arise.

In the form of the invention depicted in FIGS. 5 and 6 an integral synthetic resinous web core blank 44 is provided which includes distal end margins 46 and 48, each of lesser thickness than that of the main body of the blank. As shown in FIG. 6, end 46 comprises a relatively thin planar projection 50 having thereon an upstanding, transverse tab 52 having tapered sidewalls. A bendable tongue 54 is attached to projection 50 along a line of weakness defined by a transverse detent 56.

The remaining end 48 is of greater thickness than end 46 and includes a tapered recess 58 which is complementally configured with respect to tab 52 for purposes to be made clear hereinafter. Moreover, the inner terminus of end 48 is tapered as at 60, while the extreme end of tongue 54 is complementally tapered as at 62.

Turning now to FIG. 5, it can be seen that upon installation of core blank 44 to produce a cylindrical core 45, the distal ends 46 and 48 thereof are in connected, overlapping relationship. In particular, end 46 is adapted to engage the outer cylindrical surface of mandrel 24 with upstanding tab 52 extending from projection 50. End 48 overlies end 46 with tab 52 being received within complemental recess 58 in the well-known manner. As indicated previously, it is desirable to complementally configure the tab and recess structure 52 and 58 respectively in order to produce a frictional, snap-fit interconnection between distal ends 46 and 48.

Additionally, tongue 54 is turned downwardly along the transverse line of weakness provided by detent 56 and is inserted within slot 28 of mandrel 24 in order to insure that core 45 does not move relatively with respect to mandrel 24 when the latter is rotated during high-speed winding operations, as described.

During installation of core blank 44, the worker first turns tongue 54 downwardly and inserts the latter into slot 28. He then wraps the remainder of core blank 44 around cylindrical mandrel 24 and interconnects the distal ends 46 and 48 thereof by snapping together the tab and recess structure 52 and 58. The terminal end of web 22 is next attached thereto by means of a small stretch of masking tape (not shown) and winding can then be commenced. Upon completion of the winding operation, the finished roll with underlying core 45 is slid axially off of mandrel 24. Tongue 54 is then snapped into recess 64 provided therefor in end 48 in order to maintain the smooth inner arcuate surface of the core. For this purpose, the respective ends of tongue 54 and distal end 48 are tapered at 60 and 62 as described in order to provide a removable, snap-fit connection therebetween. In this fashion, the tongue 54 can be moved to a recessed position for use on standard reels, but can be shifted downwardly as desired should the finished roll be employed in conjunction with an axially slotted reel.

Another synthetic resin core blank 82 is shown in FIGS. 9, 10 and 11 and includes a central layer 84 of conventional synthetic resin foam such as polyurethane foam. Foam layer 84 is laminated by separate sheets of paper 86 and 88 covering the width thereof. As with the embodiment of FIG. 12, the respective end margins of blank 82 are of reduced thickness as at 90 and 92 to facilitate projection-free installation thereof on mandrel 24 with leading tongue 94 inserted within slot 28. In this instance however, because of the relatively thick nature of foam layer 84, it is preferable to provide a series of spaced transverse slits 96 along the length blank 82 to permit smooth winding thereof about the mandrel as shown in FIG. 11.

A final embodiment of the invention is depicted in FIG. 8 and includes a plurality of relatively narrow web core blanks 66 which are interconnected at spaced intervals as at 68 and provided with a common transverse line of perforation 70. This type of web core blank is especially advantageous when it is desired to simultaneously wind a plurality of separate rolls on a single mandrel. That is, a separate, relatively thin web of material can be attached to each individual core resulting from the use of blanks 66, and the common underlying mandrel can be rotated to effect a simultaneous winding of the material thereon. Upon completion of this operation the entire unit is removed from the mandrel and the separate rolls can be disengaged simply by tearing the individual web cores apart at the spaced points 68. In this connection, it has been found helpful in some instances to wind material only onto every other web core in order to facilitate accurate winding and final separation of the cores.

It will be understood that each of the embodiments of the present invention described above are particularly adapted for use in certain specific situations. For instance, the core blank 10 depicted in FIGS. 1–3 has extremely wide utility which is attributable to its low cost and operational versatility. However, by virtue of the fact that blank 10 is preferably composed of cardboard, it is also possible to use the same to wind relatively wide rolls of material followed by a slicing thereof to produce final rolls of lesser width. In this situation, it is simply a matter of cutting wider roll by means of conventional slicers which cut not only the wound material but also the core itself without difficulty.

Likewise, the synthetic resin core blank 44 described with reference to FIGS. 5 and 6 find particular advantage when heavier web materials are to be wound. In particular, by virtue of the high tensile strength and distortion-free nature of extruded plastic core 44, it is especially adapted for use in winding electrical tapes or other such relatively heavy materials.

As alluded to previously, it is sometimes difficult to quickly position the core blanks hereof on an axially slotted mandrel, particularly after the blank has been utilized for receiving itermediate web windings prior to the final rewind step to produce finished rolls of material. It has been discovered that this precedure is greatly facilitated by provision of a mandrel 98 (see FIGS. 13 and 14) having an axially aligned, smoothly tapered extension 100 thereon forming the leading portion thereof. Extension 100 includes a slot 102 which is of progressively lesser width from the leading edge thereof to its terminus which is congruent and in communication with axial slot 104 in mandrel 98.

It will be appreciated from the foregoing that with previously wound intermediate winding roll having a core in accordance with the invention, installation thereof on mandrel 98 can be effected as follows. First, the tongue portion of the core is turned downwardly and inserted within slot 102 near the forward edge thereof which of course necessitates axially aligning the roll loosely on projection 100. The roll can then be moved axially along extension 100 which progressively conforms the web core until the latter has the proper configuration for positioning on mandrel 98. Since respective slots 104 and 102 are aligned, continued movement of the roll quickly positions the same on mandrel 98 without the need of carefully monitoring the progress of the installation procedure. It will also be apparent that acidentally misshapen web cores can be reused with the present apparatus by virtue of the construction thereof and the resilience of the cores as disclosed herein. Thus, the economic losses suffered because of core distortion are effectively precluded.

Having thus described the invention, what is claimed as new and desired to be secured by Letters Patent is:

1. A web core blank adapted to be used with a cylindrical, axially rotatable winding mandrel having an axial slot therein, said blank comprising:

a generally flat, relatively thin flexible nonmetallic member of length and configuration for removable and circumferential positioning thereof about said mandrel in a closely fitting, circumscribing manner with the respective ends thereof proximally disposed and with a substantially smooth, projection-free outer arcuate web-receiving surface;

means for joining said respective ends with maintenance of said substantially smooth, projection-free outer arcuate surface to present a web core about said mandrel; and a tongue connected to said member and being operable for insertion within said mandrel slot for precluding significant relative rotational movement of the web core when said mandrel is axially rotated, said member having a perforation line spaced inwardly from one of the transverse edges of said member for defining said tongue, the latter being separable from the remainder of said member by tearing along said perforation line in order to present a substantially smooth inner arcuate surface on said web core upon removal of the latter from said mandrel.

2. The blank of claim 1 wherein said member is a rectangular sheet, said perforation line being spaced inwardly from and generally parallel with an extreme transverse edge of said sheet.

3. The blank of claim 1 wherein said member includes a plurality of spaced, generally parallel cuts along the length thereof for defining a plurality of elongated, adjacent, coextensive web core blanks, the latter being detachably interconnected at spaced intervals along the lengths thereof.

4. The blank of claim 1 wherein said member is fabricated of paper stock.

5. A web core blank adapted to be used with a cylindrical, axially rotatable winding mandrel having an axial slot therein, said blank comprising:

a generally flat, relatively thin flexible nonmetallic member of length and configuration for removable and circumferential positioning thereof about said mandrel in a closely fitting, circumscribing manner with the respective ends thereof proximally disposed and with a substantially smooth, projection-free outer arcuate web-receiving surface;

means for joining said respective ends with maintenance of said substantially smooth, projection-free outer arcuate surface to present a web core about said mandrel; and a tongue connected to said member and being operable for insertion within said mandrel slot for precluding significant relative rotational movement of the web core when said mandrel is axially rotated, said tongue being shiftably connected to said member along a generally transverse line of weakness in said member, there being a corresponding tongue-receiving recess in said member which is configured and arranged to receive said tongue when said web core is removed from the mandrel for presenting a substantially smooth inner arcuate surface on said web core.

6. The blank of claim 4 wherein said member is fabricated from synthetic resinous material with the distal ends thereof being configured to overlap when the blank is positioned about said mandrel for producing said core, each of said distal ends being of lesser thickness than that of the main body of said web core blank with the combined, overlapped thicknesses thereof being substantially equal to that of the main body of the member, there being complementary connection structure on said distal ends operable to interconnect the latter with maintenance of said substantially smooth, uninterrupted and continuous outer arcuate surface.

7. The blank of claim 6 including an integral, upright, transversely extending tab on one of said ends, with the remaining end having a complemental transverse recess therein for receiving said tab when the member is positioned about said mandrel.

* * * * *